US005716131A

United States Patent [19]

Breeding

[11] Patent Number: 5,716,131

[45] Date of Patent: Feb. 10, 1998

[54] PORTABLE FOUR CYCLE BACKPACK PENDULOUS VIBRATOR

[76] Inventor: Kenny D. Breeding, 11 Nimrod Cove, Maumelle, Ark. 72113

[21] Appl. No.: 673,371

[22] Filed: Jun. 28, 1996

[51] Int. Cl.[6] ..... B01F 11/04

[52] U.S. Cl. ..... 366/120; 224/265; 224/643; 224/644

[58] Field of Search ..... 366/108, 116, 366/117, 120–123, 128, 129, 349, 600, 601; 224/201, 261, 262, 265, 642–644

[56] References Cited

U.S. PATENT DOCUMENTS

| | | | |
|---|---|---|---|
| 2,167,987 | 8/1939 | Mall | 366/122 |
| 2,430,817 | 11/1947 | Jackson | 366/123 X |
| 2,519,936 | 8/1950 | Sayre | 224/261 |
| 2,792,670 | 5/1957 | Haynes | 224/265 X |
| 3,042,386 | 7/1962 | Wyzenbeek | 366/122 |
| 3,180,625 | 4/1965 | Wyzenbeek | 366/122 |
| 3,188,054 | 6/1965 | Mason, Jr. | 366/121 |
| 3,395,894 | 8/1968 | Hedelin | 366/121 |
| 3,608,867 | 9/1971 | Hunter | 366/120 |
| 4,483,070 | 11/1984 | Junkermann | 224/262 X |
| 4,644,654 | 2/1987 | Howe et al. | 224/262 X |
| 4,662,551 | 5/1987 | Dudley et al. | 224/262 X |

FOREIGN PATENT DOCUMENTS

| | | | |
|---|---|---|---|
| 768419 | 2/1957 | United Kingdom | 224/265 |

*Primary Examiner*—Charles E. Cooley
*Attorney, Agent, or Firm*—Stephen D. Carver

[57] ABSTRACT

A portable concrete vibrator system comprising a backpack-borne four cycle engine that powers a pendulous vibrator. The backpack comprises a rigid frame mounting a four cycle motor that is connected to the vibrator by a flex-shaft and isolated therefrom by an in-line compensator. A removable vibration absorption system isolates the user from stress. A pair of integral, divergent shoulder harnesses protrude from the backpack top and an encircling, semi-elastic waist belt protrudes from the bottom. An integral belt tensioner on each side of the belt permits the user to tighten one or both belt sides to adjust belt tightness. The backpack vibration dampening system is removable for cleaning or adjustment. The dampening system preferably comprises a thick pad that has a pair of slip-on cuffs to captivate the ends of both shoulder harnesses. A plurality of snaps or other conventional attachment points secure the remainder of the system to the frame. The frame also mounts a pair of ergonomic controls that may be easily manipulated by the user to control the power unit. The elongated flex-cable that connects the vibrator to the four cycle engine includes an internal compensator that accommodates vibrational stresses and thermal expansion and contraction.

15 Claims, 8 Drawing Sheets

PORTABLE FOUR CYCLE BACKPACK PENDULOUS VIBRATOR

BACKGROUND OF THE INVENTION

I. Field of the Invention

The present invention relates generally to motor powered, backpack mounted vibrators for concrete work. More particularly, the present invention relates to a backpack mounted vibration systems for concrete work employing pendulous vibrators, and to backpack units for such equipment that dissipate and absorb vibrations produced by the power unit.

II. Description of the Prior Art

It is well settled that freshly poured concrete must be properly vibrated after placement to facilitate consolidation. Properly applied vibration settles and densifies the concrete mass, and helps eliminate air voids. Many vibrating systems for consolidating concrete are presently in use. Preexisting concrete vibrating equipment ranges from extremely large, vibrating and screed units that ride forms to traverse freshly poured concrete, to small portable units.

Portable vibration units for consolidating freshly poured concrete may be secured to a backpack. These enable the contractor to properly densify smaller pours in a cost efficient manner. Backpack vibrator units enable the operator to easily reach difficult-to-access places that would otherwise be unreachable by large form-riding, vibrating systems.

Known backpack-borne vibrator systems employ a two-cycle engine that must run at relatively high RPM. The engine connects via a flex-shaft cable to an eccentric vibrator unit that is immersed within the concrete. As the engine rotates the flex-shaft through the cable, vibration is created by the eccentric vibrator, and transmitted to the concrete. During operation heat builds up and the flex-shaft and casing components expand. Expansion causes "preloading," in that the flex-shaft is pressured axially, stressing mechanical parts. Also, the flex shaft itself is stressed, causing excessive rubbing against the outer casing. This stress and rubbing weakens the parts, and the excessive friction generates heat that burns the hands of the operator.

Two-cycle engines are normally used to reach the desired RPM ranges for proper vibration frequencies. These engines normally run very hot, partly because they run at relatively high RPM's. Two cycle engines lack the proper torque at low RPM's. Additionally, two-cycle motors require a proper mixture of gasoline and oil for optimum operation. However, in the field, the reality is that improper oil-gas mixtures are often used. Further, operators often over-rev the engines to obtain the relatively high rotational speed required by traditional flex-shaft eccentric vibrators to produce high frequency vibration. Speed increases aggravate the heat problem. As a result, two cycle systems are inefficient, cumbersome, and unreliable. They are a continuing maintenance nightmare.

Nevertheless, two-cycle engines have traditionally been preferred because they generally produce higher RPM's. High speed is necessary for traditional flex-shaft eccentric vibrators. Further, two-cycle engines are usually smaller and significantly lighter than conventional four-cycle engines, leading to their employment in backpack systems.

Common knowledge might suggest the use of four cycle engines. They may be heavier and slower, but they are inherently more reliable and they are comparatively maintenance free. However, these engines are not be used with conventional vibrators since they do not produce the required RPM's. Gear systems have been tried for increasing speed with four cycle systems, but the size and weight increase is practically unacceptable for portable, backpack systems.

Pendulous vibrators are known in the art. They are virtually maintenance free compared to eccentric vibrators. Pendulous vibrators produce high frequency vibration with relatively low RPM inputs. They effectively multiply the primary input speed of the drive cable system three to five times. However, they require more torque than typical flex-shaft eccentric vibrators. Pendulous vibrators overly stress two cycle drive systems, causing premature bearing failure from the stress of heat and unbalanced loads.

Therefore it would seem desirable to combine a four cycle engine with a pendulous vibrator. However the weight of a typical four cycle engine has made it undesirable. Further, translational forces that result from pendulous vibration are incompatible with flex-shaft power transmission systems linked to four cycle engines. Besides the fact that torque and RPM requirements are substantially different from two cycle systems, the shock waves transmitted through conventional cable systems by pendulous vibrators are incompatible with current designs. In a backpack borne unit, stress induced strains on the drive train are severely aggravated, necessitating substantial rethinking.

An ideal concrete vibrator backpack system should meet a number of requirements. First, the system must enable the user to safely and comfortably transport the load on his back. Naturally, the backpack should be comfortable to wear. Weight must be minimized, and it must be distributed relatively evenly to preserve operator mobility and balance. Weight borne upon the shoulders of the wearer must be cushioned to avoid rashes and discomfort. Mechanical parts should be flushly and compactly mounted—they must not obstruct or contact the operator. The load must be stable and it must be secure, so that applicator dexterity is only minimally compromised. Vibration and heat must be isolated from the wearer.

Not only must the entire unit meet the foregoing considerations, it must concurrently function smoothly and reliably to aid the operator in speedily fulfilling his job requirements in a workmanlike manner. In the past different backpack power unit designs have been proposed, at least partially in response to such design criteria.

Conventional prior art backpack designs generally employ a rigid frame with a pair of captivating shoulder straps. The user secures the load to the frame and then places his arms in the straps to lifts and carry both the backpack and the load. Some backpack designs include waist belt mounted to the frame for distributing weight relatively evenly. A backpack with a waist belt eases the burden in carrying heavier loads presented by internal combustion engines. A number of small internal combustion engines borne by backpack systems power a diverse variety of tools, including weed trimmers, air blowers, vacuums, etc. As backpack mounting systems evolve, the engines continue to get more powerful, and consequently bigger and heavier. Also, the tools typically employed have become more diverse.

These heavier engines and tools place greater demands upon the user during transportation and operation because of the heavy weight and the vibrations generated by the engine. Given the primary objectives of backpack design, it is imperative that the backpack adequately disperse the weight of the unit over the user's entire back while both absorbing and dissipating the vibrations generated by the engine.

An ideal backpack would substantially isolate the vibrations generated by the engine from the user. A particularly ideal backpack would use a removable vibration isolation system. Such a system could be easily removed for cleaning purposes and could then be reinstalled for when desirable.

Another important consideration with backpack mounted power units, particularly with heavier power units, is the ease of donning the backpack. All known prior art backpacks utilize a pair of shoulder straps which substantially captivate the shoulders. Unfortunately, the straps can be difficult to put on, especially if the user is inexperienced. Unfortunately, it may become necessary for the user to quickly remove the backpack in an emergency. Thus, an ideal backpack would have a simple coupling that could be easily connected or disconnected by the user. A particularly desirable backpack would have a quick connect belt and easy-on and easy-off straps or harnesses that would facilitate quick user removal. Of course, such a backpack must heed the basic goal of comfortable movement.

Furthermore, since one prime consideration with any backpack mounted power unit is ease of use. A backpack design that increases control over the engine would be ideal. Most engines require an on/off switch as well as throttle control devices to regulate for the engine speed. A particularly convenient backpack design would permit the user to easily manipulate such controls without removing or adjusting the backpack. A particularly ergonomic design would place these controls at the user's fingertips.

SUMMARY OF THE INVENTION

My pendulous vibrator backpack system overcomes the perceived problems associated with the known prior art as discussed above. The backpack interfits with a rigid frame comfortably mounting a small, four-cycle engine that powers a pendulous vibrator for settling and consolidating concrete. Alternatively, the backpack-supported power unit may be used to drive a variety of remote tools.

A pair of integral, divergent shoulder harnesses protrude from the top of the backpack unit. An encircling, semi-elastic waist belt protrudes from the frame bottom. Preferably, the belt comprises VELCRO ®-brand pile and hook fasteners that enable the user to unfasten the belt with a single hand. An integral belt tensioner on each side of the belt permits the user to tighten one or both belt sides. Preferably, both belt tensioners use similar pile and hook fasteners. Thus, the belt may be coupled and adjusted with only one hand.

The shoulder harnesses cooperate with the encircling waist belt to secure the load on the user. Preferably, the shoulder harnesses are an easy-on and easy-off, open design that permits the user to simply slip his shoulders under them. Then, the belt is snugly coupled about the user's waist to mount the backpack on the user. Thus, the backpack may be easily donned by the user or quickly removed by the user as necessary.

The backpack system also uses a unique vibration dampening system to substantially reduce the transfer of vibrations generated by the engine and tool to the user. The vibration dampening system is also preferably removable from the frame for cleaning or other adjustment purposes. The dampening system preferably comprises a thick pad that has a pair of slip-on cuffs to captivate the ends of both shoulder harnesses. A plurality of snaps or other conventional attachment points secure the remainder of the system to the frame.

The frame mounts a pair of ergonomic engine controls that may be easily manipulated by the user to control the power unit. One control preferably governs engine operation while the other regulates engine speed.

Preferably the engine is of four cycle design. The remote, pendulous vibrator is coupled to the engine through an elongated flex-cable that is quick-connectable to an engine fitting. Heat-generated cable elongation is accommodated by a special fitting joining the engine and cable.

Thus, a primary object of the present invention is to provide a highly portable concrete vibrating system.

Another important object is to provide a backpack-transported concrete vibrating system that successfully unites a pendulous vibrator with a four cycle engine.

A related object is to provide a flex-shaft system for a backpack-transported concrete vibrating system that successfully drives a pendulous vibrator with a four cycle engine.

A still further object is to provide a portable vibrator adapted to take advantage of the inherent reliability of four cycle engines.

Yet another object is to reduce maintenance and wear and tear by slowing down most of the components of a backpack vibrator system.

Another object is to provide an ergonomic, easily donned backpack power unit that absorbs and disperses vibrations generated by the engine.

A further basic object is to provide an easily removable vibration isolation system that may be field separated from the backpack for cleaning and/or adjustments.

Another primary object is to provide a backpack of the character described that may be quickly put on and removed by the user. It is a feature of the present invention that the securing belt may be uncoupled with one hand.

Yet another basic object of the present invention is to provide a backpack mounted power unit that spreads the weight of the unit evenly over the user's shoulders and back.

A related object is to provide a pendulous vibrating system for concrete work that is comfortable and stable.

Another basic object of the present invention is to provide a portable power unit that may be used to power a variety of associated hand tools.

A related object of the present invention is to provide a portable power unit and an associated hand-held concrete vibrator.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
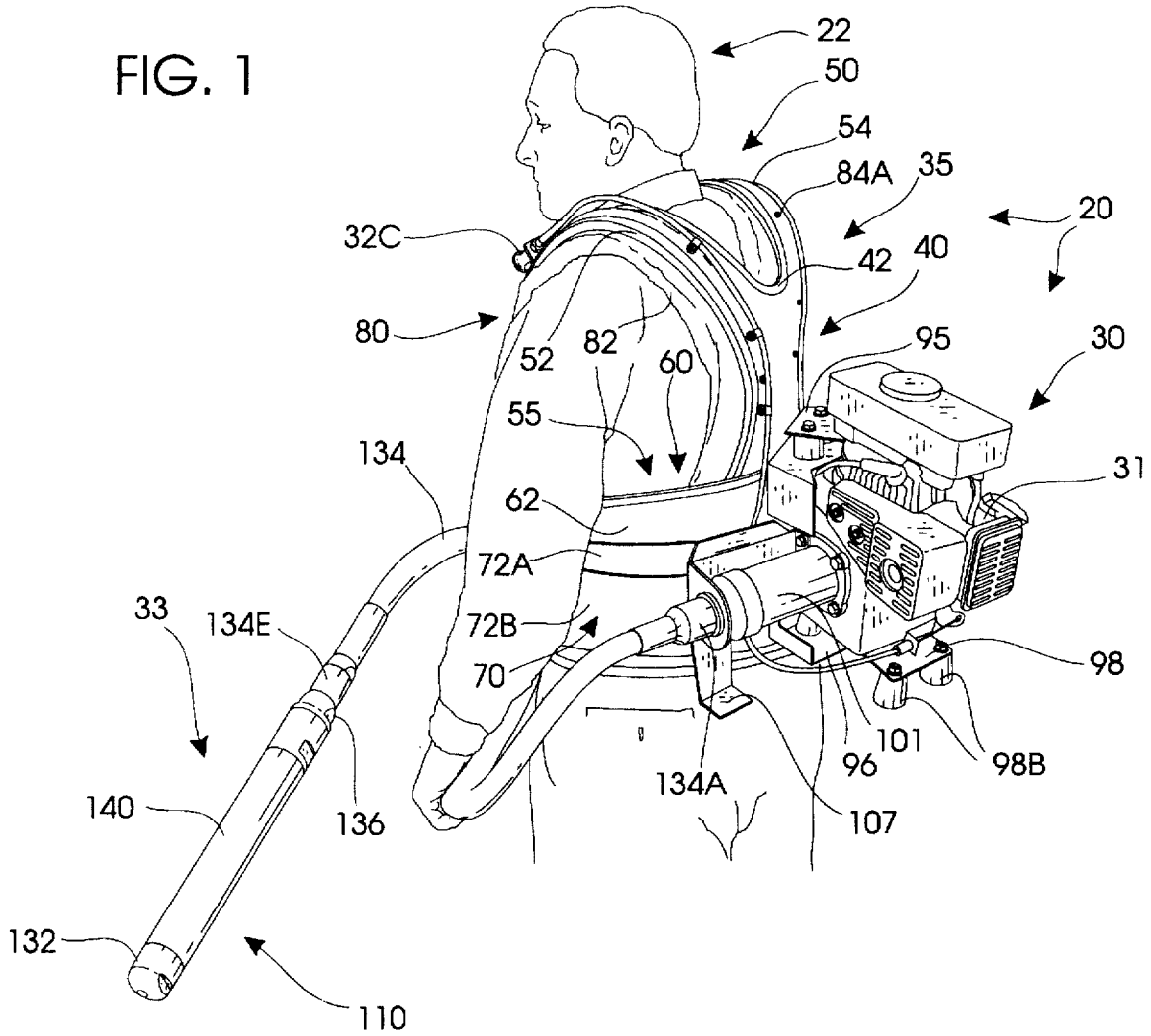
FIG. 1 is a fragmentary, pictorial view showing a preferred embodiment of my backpack vibrator.

Referring more specifically to the drawings, my improved backpack vibrator system is generally designated by the reference numeral 20 in FIGS. 1–7. Backpack vibrator 20 is worn by user 22 (FIGS. 1–2) during transportation. The motor power unit 30 powers a remote pendulous vibrator 33. The backpack power unit 20 comprises a backpack 35 secured to user 22 that supports the power unit 30 and tool 33. Power unit 30 generally comprises an internal combustion engine 31 controlled by switch 32A and throttle lever 32C. Preferably, switch 32A and lever 32C may be easily reached by user 22 when backpack unit 25 is worn.

The backpack 35 comprises an elongated rigid frame 40 secured to the user 22 by a shoulder harness subframe 50 and a belt assembly 60. A vibration dampening system 80 fits between the backpack 35 and the user 22 to prevent the transfer of vibrations therebetween.

The rigid frame 40 has a top 42 and a spaced apart bottom 44 and an interior 46 and a spaced apart exterior 48 (FIGS. 3–7). Two orifices 49 penetrate the frame 40 to permit the attachment of selected power units 30, as will be more fully discussed hereinafter. The frame 40 is secured on the user 22 by an integral, arcuate shoulder harness subframe 50 and a belt assembly 60.

Figure 2:
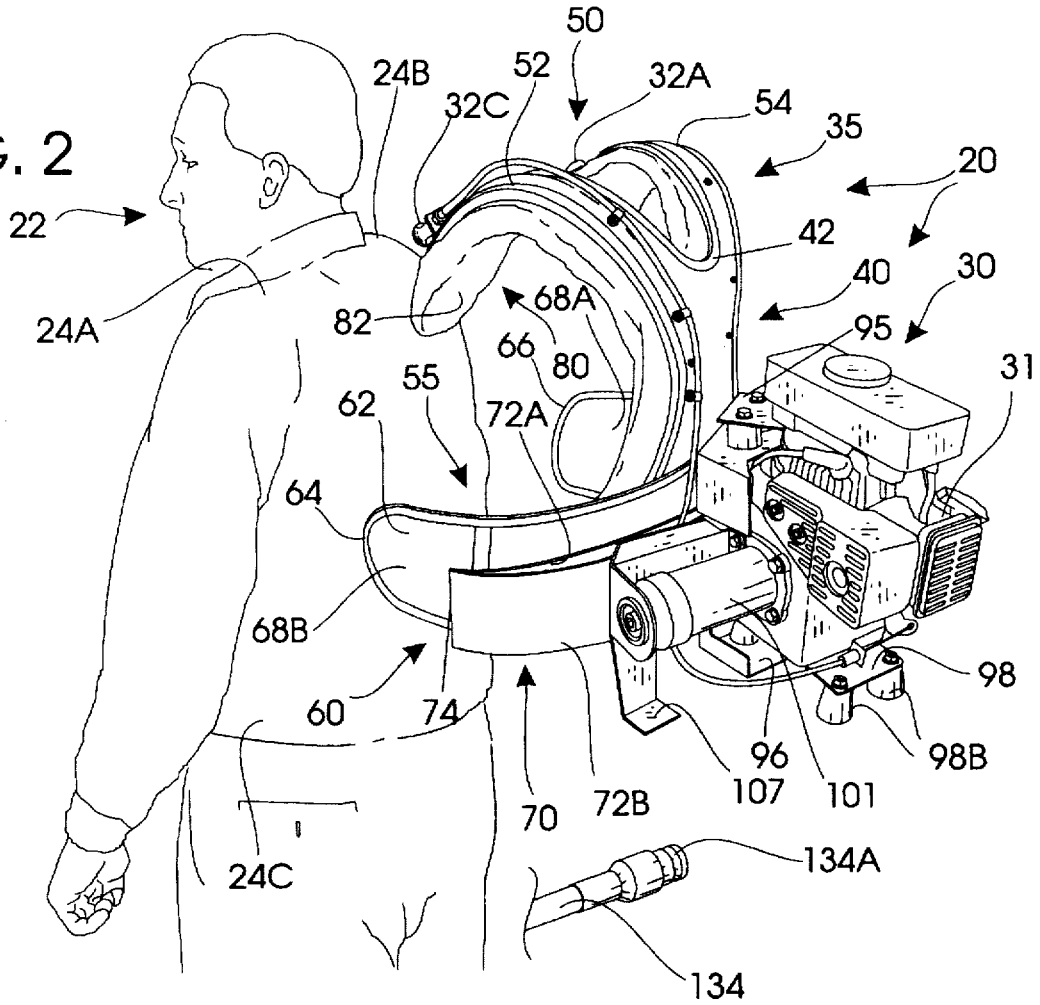
FIG. 2 is a fragmentary, partially exploded view similar to FIG. 1 showing the backpack removed from the user.
Figure 3:
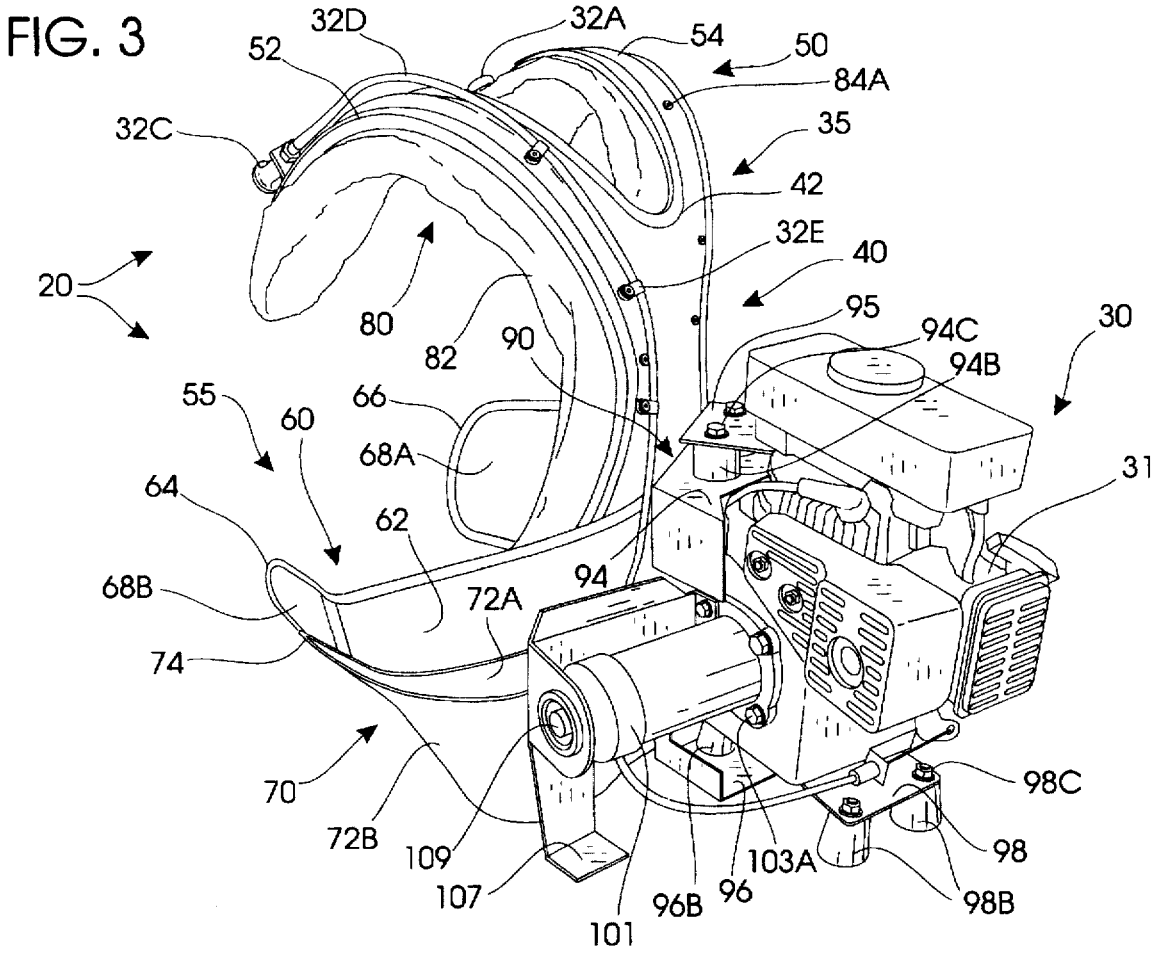
FIG. 3 is a fragmentary left rear perspective view.
Figure 4:
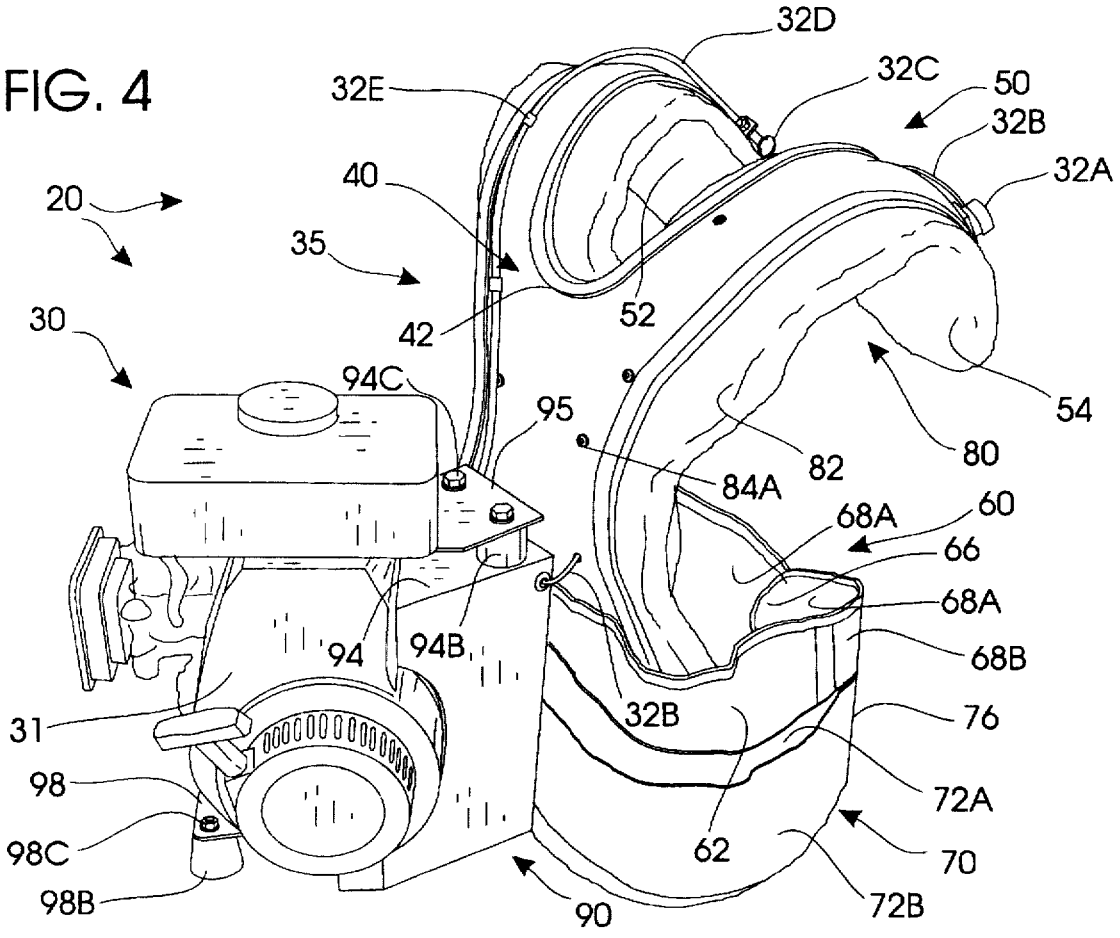
FIG. 4 is a fragmentary right rear perspective view.

The shoulder harness subframe 50 protrudes outwardly from the frame top 42. The subframe 50 comprises two divergent, arcuate shoulder harnesses 52, 54 that conform to and snugly fit over the user's shoulders 24A, 24B (FIG. 2). Each harness 52, 54 has a terminal end 52A, 54A that rests adjacent the user's chest when backpack unit 20 is properly worn.

Preferably the belt assembly 55 attaches to the frame bottom 44. Assembly 55 comprises a semi-elastic primary belt 60 and a more elastic tensioning belt 70. Primary belt 60 comprises an elongated webbing 62. Webbing 62 has a pair of spaced apart terminal ends 64,66. Preferably, each surface 68A, 68B of ends 64, 66 are appropriately covered with VELCRO fastening material. In the preferred embodiment, surface 68A is covered by VELCRO® hooks while surface 68B is covered by pile. Thus, surfaces 68A, 68B facilitate one-handed mating of ends 64, 66. Two spaced apart orifices 69 penetrate the belt 60 adjacent its midpoint to permit attachment of the belt 60 to the frame bottom 44. A complimentary tensioner 70 permits the user 22 to easily adjust the tightness of belt 60.

Tensioner 70 comprises a pair of elongated straps 72A, 72B joined at spaced apart ends 74, 76 that attach to belt 60 adjacent the user's sides 24C (FIG. 2). Preferably, inner strap 72A angles upwardly toward frame top 42 at midpoint 75 to maintain tension on harness subframe 50. Interior surface 78 on ends 74, 76 is appropriately covered with VELCRO hook material to fasten to surface 68B on belt ends 64, 66. Thus, tensioner ends 74, 76 maintain tension on ends 64, 66 to ensure that belt 60 is tight. An orifice 79 penetrates tensioner 70 adjacent midpoint 75 to secure tensioner 70 to frame 40.

When worn, backpack unit 20 uses a selectively removable vibration dampening system 80 to substantially reduce the vibrations transferred from the power unit 30 to user 22 during operation. The dampening system 80 attaches to the interior of frame 40 and shoulder subframe 50. In other words, the dampening system attaches between the user and the backpack 35.

Figure 5:
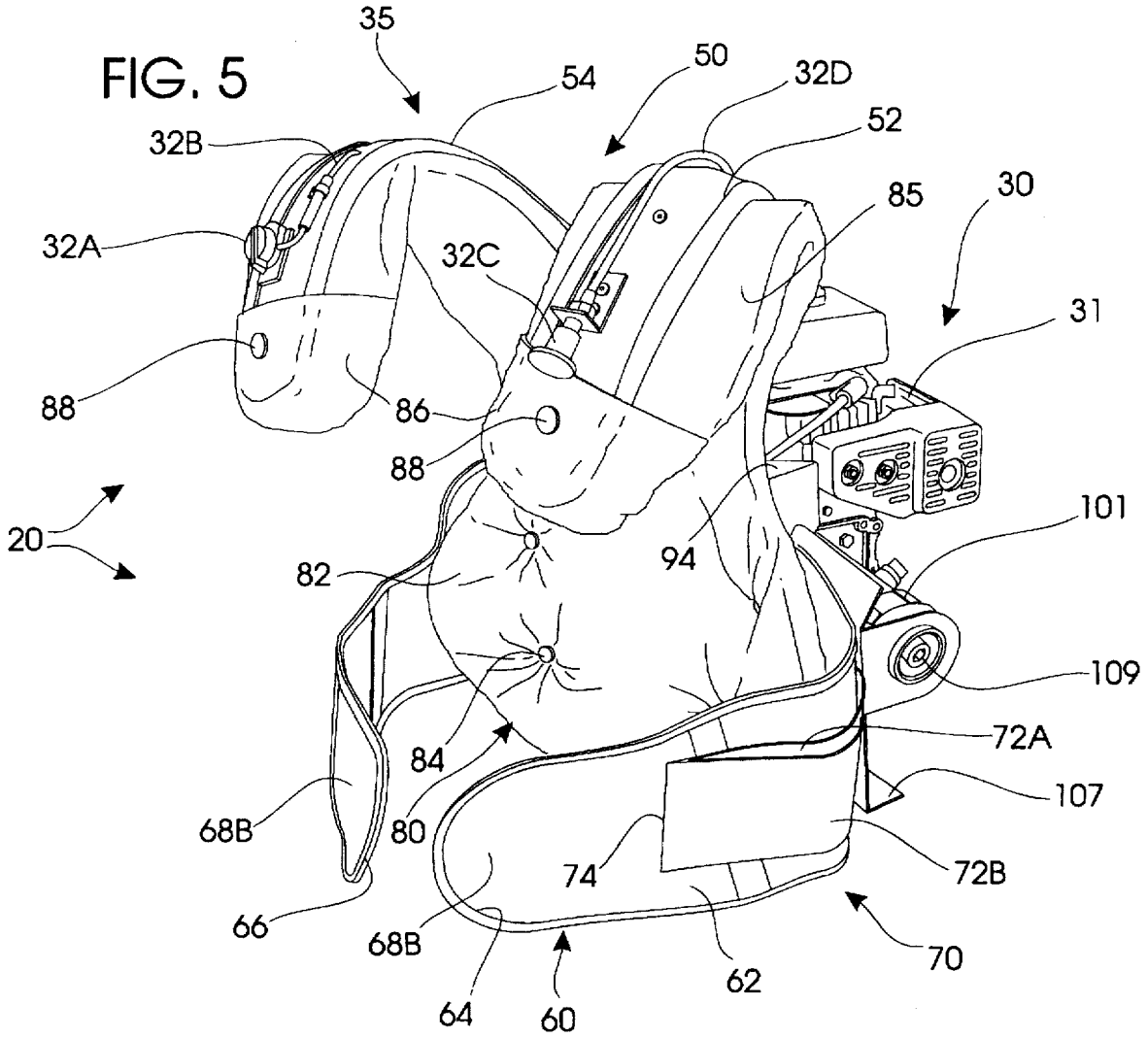
FIG. 5 is a fragmentary left front perspective view.
Figure 6:
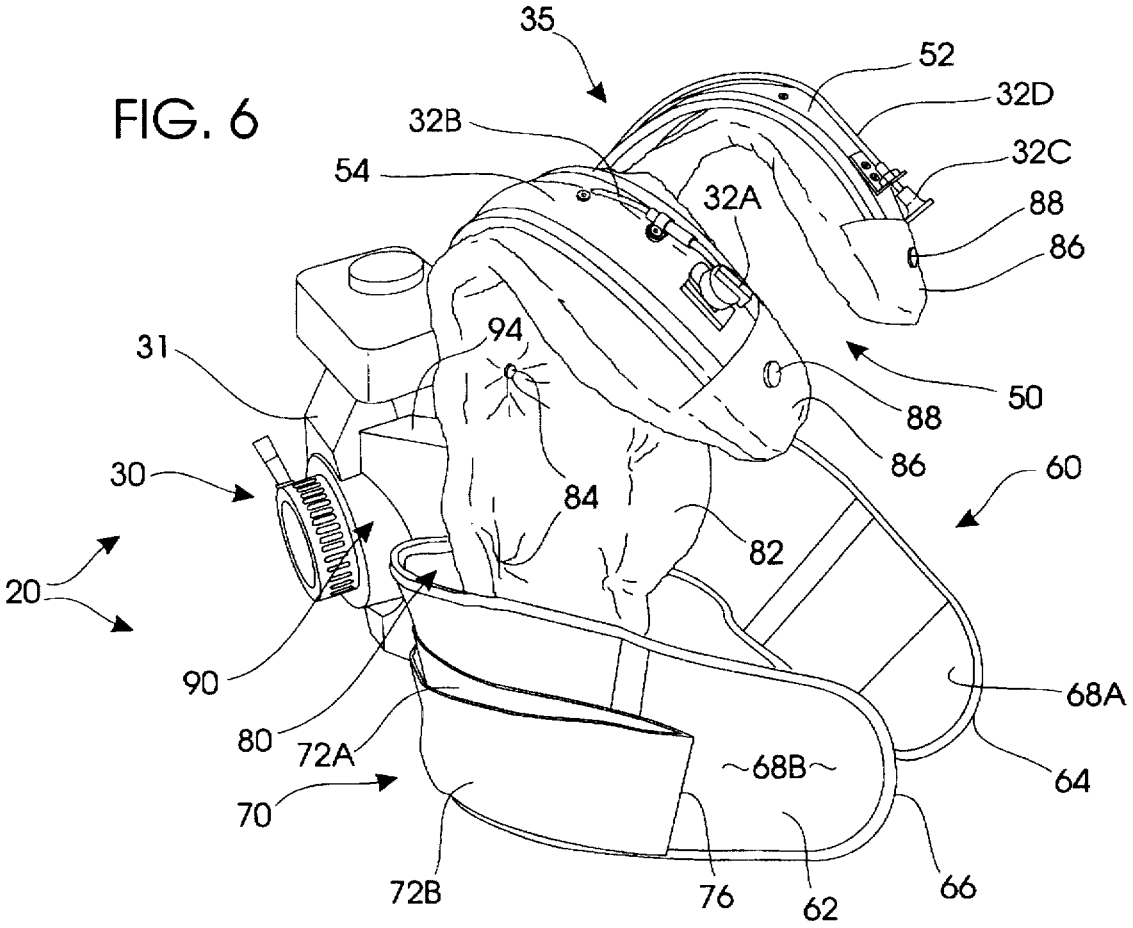
FIG. 6 is a fragmentary right front perspective view.
Figure 7:
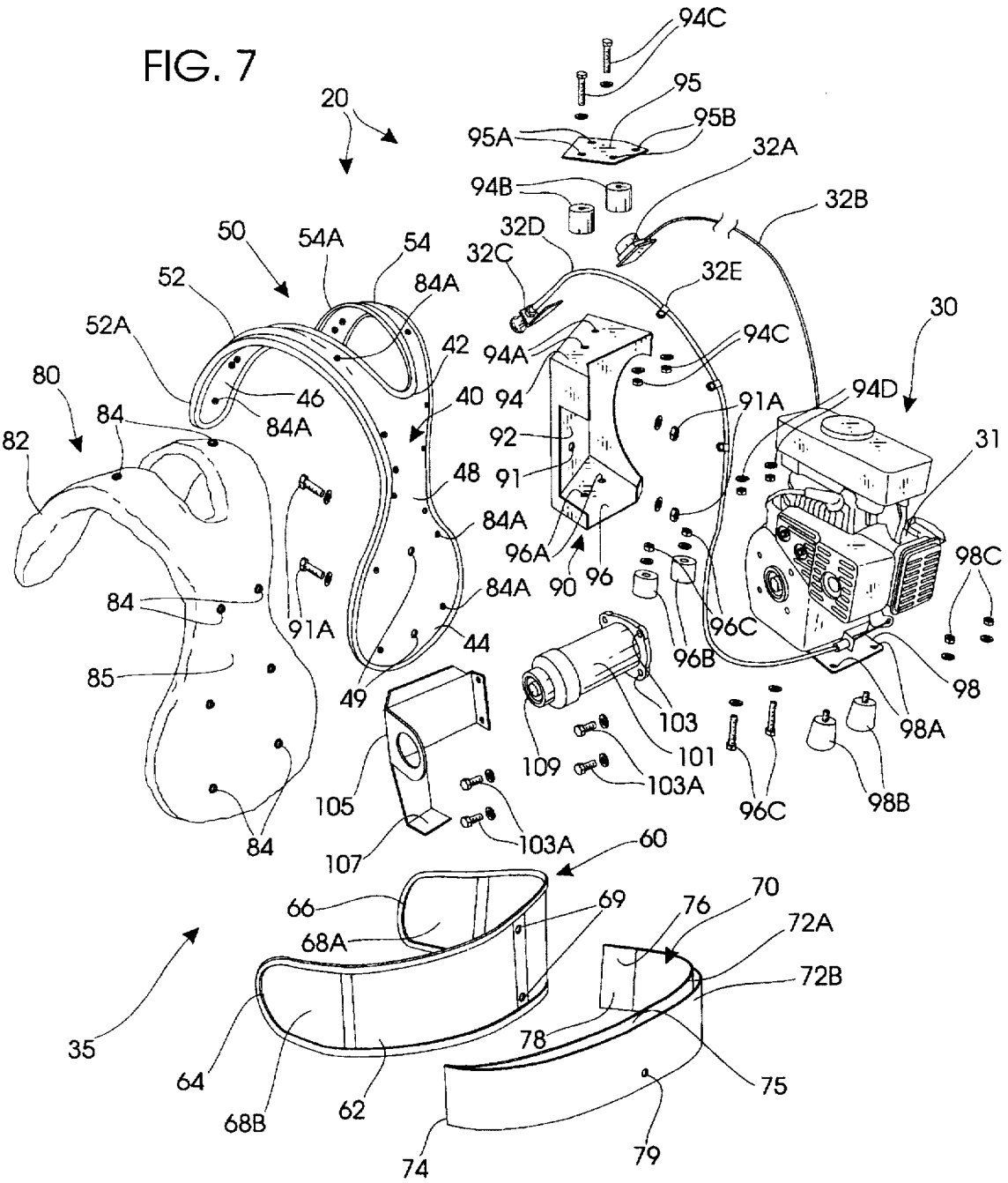
FIG. 7 is a fragmentary partially exploded isometric view.

Preferably, the dampening system comprises a padded body 82 that conforms to the interior dimensions of the frame 40 and the shoulder harness subframe 50. A plurality of conventional snaps 84 are spaced about the exterior surface 85 of the body 82 to secure it to appropriate receivers 84A on the frame 40 and subframe 50. A pair of hollow sleeves 86 slip over and captivate each shoulder harness end 52A, 54A to secure the upper section of the body 82. Two snaps 88 secure the sleeves 86 to the subframe 50 (FIGS. 5–6). Thus, the padded body 82 provides a cushion that dampens all vibrations generated by power unit 30 and/or tool 33.

As mentioned previously, frame mounting orifices 49 permit the selective attachment of alternative power devices to the backpack 35. A mounting bracket 90 secures the chosen power unit 30 to frame 40. Appropriate conventional mounting hardware (i.e., bolts, washers and nuts) 91A penetrates plate orifice 91, frame orifices 49, belt orifices 69 and tensioner orifice 79 to secure the belt 60, tensioner 70 and mounting bracket 90 all to frame 40.

Mounting bracket 90 comprises a flat mounting plate 92 terminating at cap 94 and spaced apart base 96. Cap 94 secures the upper portion of power unit 30 while base 96 secures the lower portion of power unit 30 to backpack 35. Cap 94 is penetrated by a pair of mounting orifices 94A. Two resilient, vibration absorbing isolators 94B raise an intermediary attachment plate 95 above cap 94. Plate 95 is penetrated by orifices 95A that receive conventional mounting hardware 94C. A pair of studs (not shown) penetrate orifices 95B receive washers and nuts 94D to secure engine 31 to frame 40.

Base 96 and partially shown plate 98 perform functions similar to cap 94 and plate 95. Base 96 is penetrated by a pair of orifices 96A. Two resilient, vibration reducing isolators 96B are placed between appropriate mounting hardware 96C and bracket 98. A pair of resilient, studded vibration isolators 98B have projecting threads that penetrate orifices 98A on the outer portion of plate 98 and receive appropriate mounting hardware 98C. Thus the power unit 30 is securely attached to the frame 40 at its upper and lower extremities.

As stated previously, power unit 30 preferably comprises an internal combustion engine 31. Engine 31 is controlled by kill switch 32A and throttle control lever 32C. Kill switch cable 32B is appropriately routed through an orifice in frame 40 while throttle control cable 32D is appropriately fastened to frame 40 by tabs 32E.

Engine 31 (FIG. 7) turns a quick coupling assembly 101 that is secured to the engine by conventional mounting hardware 103A penetrating orifices 103. A reinforcing bracket 105 secures the end of assembly 101. Bracket 105 is also secured via mounting hardware 103A. Reinforcing bracket 105 ends with a terminal stand 107 that cooperates with isolators 98B to support backpack unit 20 when placed upon the ground or other similar surface. An internal, rotatable quick coupling 109 housed in assembly 101. is driven by the output shaft of engine 31. It is quick connected to the flex hose leading to the pendulous vibrator.

Figure 8:
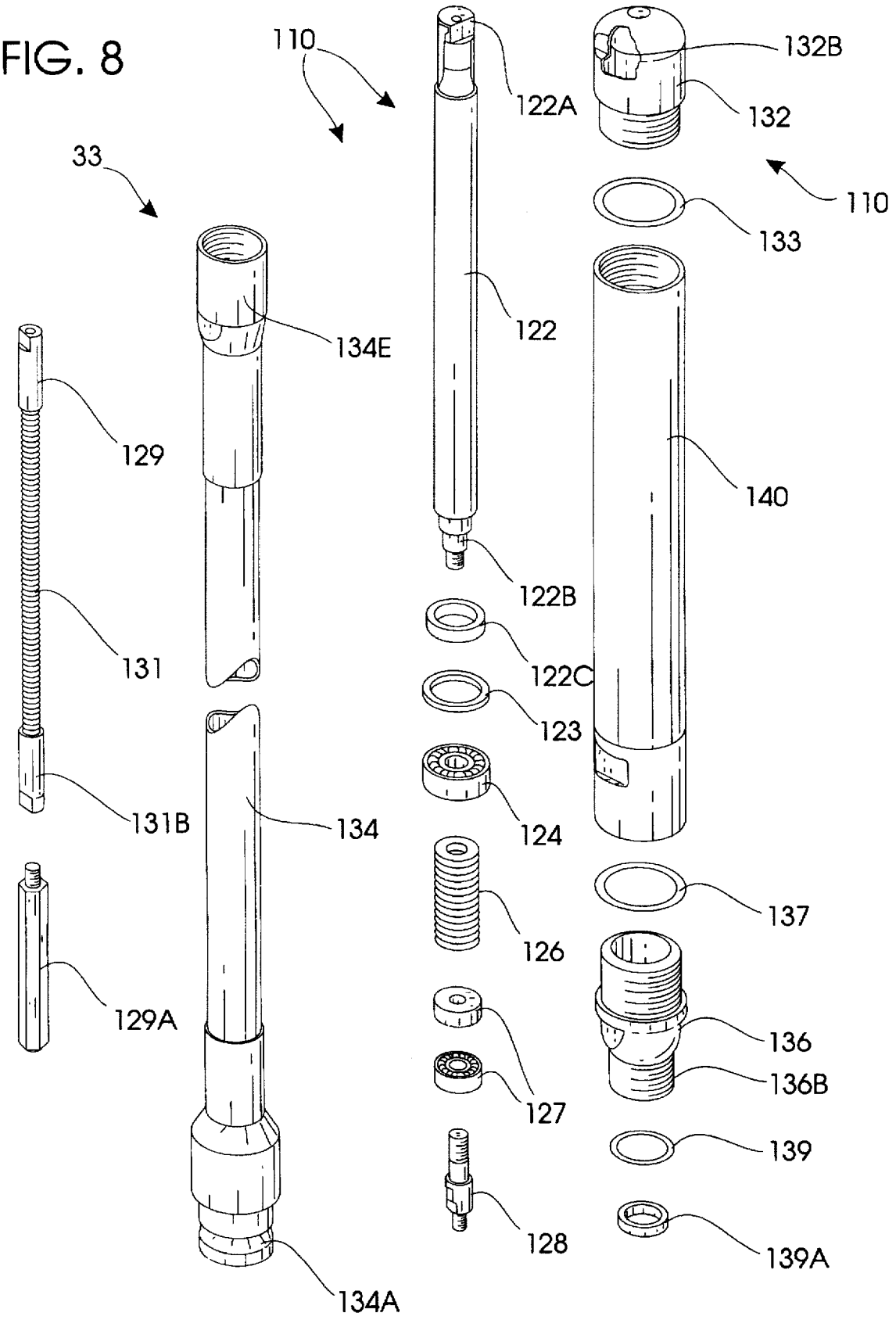
FIG. 8 is a fragmentary exploded isometric view of the vibrator assembly.

The preferred pendulous vibrator 110 is driven by engine 31 (FIG. 8). Vibrator 110 is driven by an elongated, flexible hose assembly 134 whose end 134A is removably quick coupled to the motor coupling 109. A flexible drive extension 131 threadably couples to a compensator 129A at end 131B. The compensator comprises a rigid, floating hex extension that is received within the motor quick connect coupling 109 and is free to slide in response to bending or twisting of the flex cable, or to heat expansion or contraction. Flex drive 131 is coaxially rotated within hose assembly 134. Its drive head 129 is threadably coupled to shaft connector 128.

The inner pendulum shaft 122 coaxially rotates within hose assembly 134. When assembled and in use it points downwardly coaxially within casing 140. Shaft 122 has an eccentric shoulder 122A at one end. An opposite threaded end 122B that penetrates oil seal 122C. A spacer 123 and bearing 124 position the shaft against a spring 126 that absorbs longitudinal displacements of pendulum shaft 122. Bearing structure 127 cooperatively captivates spring 126 against shaft 122. Shaft 122 is thus rotated by the slidable compensator 129A that is quick coupled to the motor. Flex drive 131 is rotated by spline 109 when the engine 31 is running. Axial forces are dissipated by movement of compensator 129A, that also compensates for thermal expansion as the system gets hotter.

Vibrator casing 140 threadably receives a terminal nose 132 about intermediary O-ring 133 that seals the connection. Casing 140 terminates at its opposite end with a reducer 136 sealed with an intermediary O-ring 137. The shaft 122 and its end 122A rotatably collide during rotation with inner shoulder 132B of nose 132. Shaft 122 hangs downwardly like a pendulum within casing 140, and when the casing is tilted, shaft end 122A forcibly contacts shoulder 132B. This periodic, accelerated impact causes intense vibration that is distributed through the apparatus to the concrete at frequencies three to five times higher than shaft rotational speed.

Importantly, the bearings 124 and 127, and other parts "behind" shoulder 132B are running at the primary input speed, reducing wear and friction and heat accumulation. Adaptor 136 is connected to the opposite end of casing 140 and sealed with gasket 137. End 134E of casing 134 is threadably mated to end 136B of reducing adapter 136 with an appropriate O-ring 139 and oil seal 139A therebetween.

OPERATION

In use the apparatus is donned by user 22 who simply places the shoulder harnesses 52, 54 over shoulders 22A, 22B. Then, the belt 60 is fastened by mating ends 64, 66. The belt 60 is then tightened by attaching tensioner ends 74, 76 adjacent each end 64, 66 respectively.

The motor may then be started or it may alternatively be started before donning the backpack 35. The engine may be conveniently governed by manipulating the kill switch 32A. The user 22 can also conveniently regulate the engine speed via lever 32C.

Removal of the backpack power unit 20 is reverse to the donning procedure. First, the engine 31 is killed via switch 32A. Then, the tensioners are unfastened by pulling ends 74, 76 outwardly. Next, the belt 60 is unfastened by pulling ends 64, 66 outwardly. Finally, the backpack may be placed on the ground or other suitable surface 27 and the harnesses 52, 54 removed from the user's shoulders 24A, 24B.

Once the motor is started, vigorous rotation of the shaft 122 forces contact of shoulder 122A against inner shoulder 132B. Substantial vibration is produced by these periodic, rotation induced collisions. Nose 132 is simply immersed within the mass of concrete to be consolidated. Depending upon heat buildup, elongation of the vibrating assembly and the flexible connection is compensated for by the compensator 129A.

Thus the apparatus described facilitates and accommodates the relatively high power of the four cycle motor and the intense vibration of the pendulous vibrator. At the same time, operator comfort, ease of use, and safety are insured.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable concrete vibrating system adapted to be worn and transported by a user for consolidating plastic concrete, said system comprising:

a backpack worn by the user for supporting and transporting the system;

a four cycle motor mounted to said backpack;

a vibrator powered by said motor, said vibrator comprising an elongated casing and a pendulum shaft rotatably, generally coaxially disposed therewithin for forcibly impacting the casing in response to movement;

a flexible connection between said backpack and said vibrator extending between the user and the concrete; and, compensating means inside said connection for accommodating axial stresses caused by said vibrator.

2. The system defined in claim 1 wherein said compensating means torsionally couples the flexible connection to said motor, and said compensating means slides within said connection in response to heat buildup and stresses to prevent over tensioning of said connection.

3. The system defined m claim 1 whereto the backpack comprises a dampening system for absorbing vibrations generated by said vibrator during operation and isolating the user from the vibrations.

4. The system defined in claim 3 wherein said backpack comprises a frame, said frame comprising:

a spaced apart top and bottom;

two integral shoulder harnesses protruding from said frame top;

a semi-elastic belt attached to the bottom of said frame; and, tensioning means for tightening said belt, said tensioning means comprising cooperating, spaced apart tensioners located on said belt.

5. The system defined in claim 4 wherein said dampening system comprises an elongated pad selectively secured to the frame.

6. The system defined in claim 4 wherein said harnesses snugly fit over the user's shoulders and said belt encircles the user's waist and said belt is tightened by said tensioning means to selectively secure said backpack to the user.

7. The system defined in claim 1 further comprising a throttle lever adapted to regulate the speed of said motor and a power switch for killing said motor.

8. A portable concrete vibrating system adapted to be worn and transported by a user for consolidating plastic concrete, said system comprising:

a four cycle internal combustion motor;

a backpack to be worn by the user for supporting the motor, said backpack comprising:

a rigid frame comprising protruding shoulder harness means for engaging said user;

belt means attached to said frame for securing the backpack to the user;

tensioning means for tightening said belt means;

control means for manipulating said motor, said control means mounted on said frame; and, vibration isolator means for isolating motor vibration from the user;

a pendulous vibrator powered by said motor and adapted to be carried by said user to a job site;

a flexible connection between said backpack and said vibrator; and, wherein the backpack comprises a dampening system for absorbing vibrations generated by said pendulous vibrator during operation.

9. The system defined in claim 8 wherein said flexible connection comprises a flex drive and a compensator for coupling the flex drive to said motor, said compensator slidable relative to said mother in response to stresses and heat buildup to prevent tensioning of said connection.

10. The system defined in claim 9 wherein said harness means snugly fit over the user's shoulders and said belt means loops around the user's waist and said belt means is tightened by said tensioning means to selectively secure said backpack to the user.

11. The system defined in claim 9 wherein said dampening system comprises an elongated pad selectively secured to the frame.

12. A portable, pendulous concrete vibrating system adapted to be worn and transported by a user for consolidating plastic concrete, said system comprising:

a four cycle internal combustion motor for powering the system;

back pack means for transporting said motor, said back pack means comprising protruding shoulder harness means for engaging said user;

a quick connect, pendulous vibrator powered by said motor and adapted to be carried by said user to a job site;

a flexible connection between said backpack and said vibrator;

compensator means within said connection for accommodating stresses from said vibrator; and, dampening means secured to said back pack means for isolating the user from vibrations.

13. The system defined in claim 12 wherein said compensator means is slidable relative to said motor in response to heat buildup or stress to prevent tensioning of said connection.

14. The system defined in claim 12 wherein said harness means snugly fits over the user's shoulders and further comprises a belt that loops around the user's waist and is tightened by tensioning means to selectively secure said backpack to the user.

15. The system defined in claim 12 wherein said dampening means comprises an elongated pad removably secured to said backpack means.

* * * * *